United States Patent [19]

Herbert

[11] Patent Number: 4,846,738

[45] Date of Patent: Jul. 11, 1989

[54] FUSEHOLDER CONTACT FOR CLASS CC REJECTION FUSES

[75] Inventor: William G. Herbert, Ellisville, Mo.

[73] Assignee: Cooper Industries, Inc., Houston, Tex.

[21] Appl. No.: 223,508

[22] Filed: Jul. 25, 1988

[51] Int. Cl.[4] ..... H01R 85/24

[52] U.S. Cl. ..... 439/831

[58] Field of Search ..... 439/831

[56] References Cited

U.S. PATENT DOCUMENTS 4,097,114 6/1978 Motten, Jr. ..... 439/831
4,108,531 8/1978 Reynolds ..... 439/831
4,278,316 7/1981 White ..... 439/831
4,761,148 8/1988 Sappington ..... 439/831

*Primary Examiner*—Joseph H. McGlynn
*Attorney, Agent, or Firm*—Nelson A. Blish; Eddie E. Scott; Alan R. Thiele

[57] ABSTRACT

A rejection fuseholder (10) for Class CC fuses (30) having a leaf spring (22) to hold fuse (30) in contact with rejection contact assembly (14). Spacer (16) prevents fuses other than Class CC fuses from making electrical contact with rejection contact assembly (14). Assembly contact (14) is concave in shape and of a diameter greater than rejection nipple on fuse (30) so that electrical contact is made all around the circumference of rejection nipple of fuse (30) and centers fuse (30) in the contact.

5 Claims, 2 Drawing Sheets

FUSEHOLDER CONTACT FOR CLASS CC REJECTION FUSES

BACKGROUND OF THE INVENTION

This invention relates in general to fuseholders and, in particular, to fuseholders having a rejection feature such that only cartridge fuses of a certain amperage rating may be inserted.

In some electrical circuits requiring fuses, it is important that only fuses with the proper interrupt rating are installed. To ensure the installation of proper rated fuses, a rejection feature is incorporated into the fuse so that fuses without this rejection feature will not be accepted by the fuseholder. For example, in Class CC fuses which have a 200,000 amp interrupt rating, a nipple has been added to one of the fuse ferrules. This nipple acts in cooperation with a specially designed fuseholder for Class CC fuses so that fuses not having the nipple cannot be installed or, if installed, will not make electrical contact with the fuseholder.

The present design Class CC fuseholder suffer from various limitations. For example, in one design, the rejection feature of the fuseholder also provides electrical contact for the fuse but only at two points thus providing poor electrical contact. In another fuseholder design, the clip holding the end of the fuse having the rejection feature may cause the rejection nipple to be off center and have poor electrical contact.

SUMMARY OF THE INVENTION

The present invention overcomes many of the disadvantages associated with prior art rejection fuseholders by providing a rejection contact which centers the fuse in the fuseholder thereby ensuring good electrical contact around the entire circumference of the fuse rejection feature. The present invention also automatically compensates for variations in fuse length, diameter, and shape of the rejection nipple provided by difference manufacturers.

DETAILED DESCRIPTION OF THE INVENTION

Figure 1:
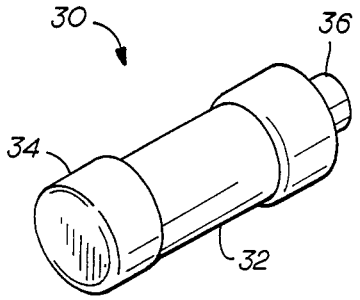
FIG. 1 is a perspective view of a Class CC cartridge fuse.

FIG. 1 shows a fairly typical Class CC fuse referred to in general by numeral 30. Fuse 30 is comprised of a cylindrical insulating fuse body 32 with a standard electrical conducting ferrule 34 at one end. At the opposite end of fuse 30, an electrically conducting rejection nipple 36 is incorporated. The rejection nipple prevents fuses other than Class CC fuses from being inadvertently or intentionally placed in a circuit using a Class CC fuseholder block.

Figure 2:
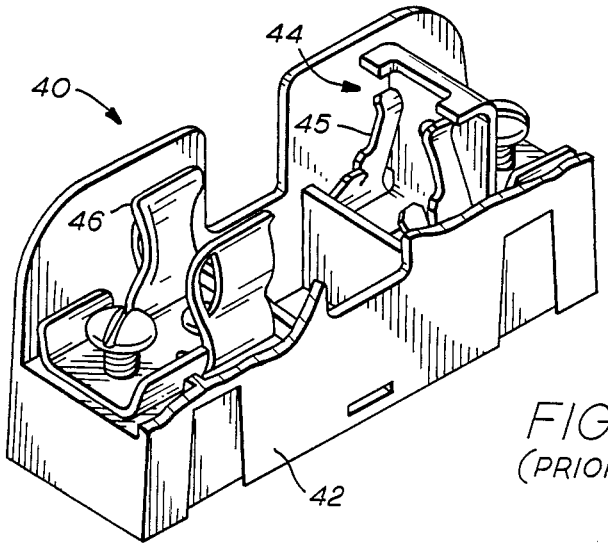
FIG. 2 (PRIOR ART)
FIG. 2 is a perspective view of a prior art fuseholder.

FIG. 2 shows a prior art fuseholder, referred to in general by numeral 40, incorporating a rejection feature. Fuseholder 40 is comprised of an insulating body 42, fuse clip 46, and rejection contact assembly 44. Rejection contact assembly 44 has two prongs 45 which are adapted to fit around a standard Class CC fuse rejection nipple 36. This type fuseholder has several drawbacks in that electrical contact is made only at the two prongs which touch the fuse rejection nipple 36 at two places. Also, there is no provision made for fuses having differences in length or rejection nipples having differences in diameter or geometry such as having a larger or smaller radius around the end and at the base of the rejection nipple.

Figure 3:
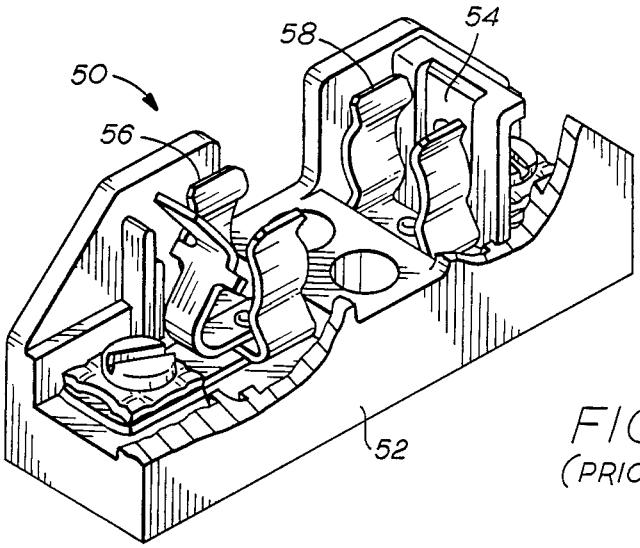
FIG. 3 (PRIOR ART)
FIG. 3 is a perspective view of a second prior art fuseholder.

One attempt to solve this problem is another prior art fuseholder referred to in general by numeral 50, design shown in FIG. 3. Fuseholder 50 is comprised of an insulating body 52, rejection contact assembly 54, first fuse clip 56, and second fuse clip 58. In this embodiment, electrical contact is provided through a metal contact 54 which makes contact with the entire top of the rejection nipple 36. The other electrical contact is made with first fuse clip 56. Second fuse clip 58 serves merely to hold the fuse in place. This fuseholder has some drawbacks in that there is a danger that insufficient electrical contact may be provided at the rejection contact assembly since second fuse clip 58 may not center the fuse against contact 54.

Figure 4:
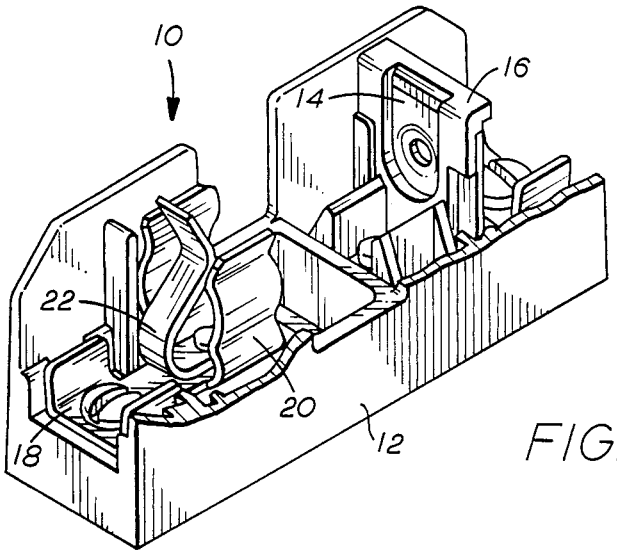
FIG. 4 is a perspective view of a fuseholder according to the present invention.

The present invention shown in FIG. 4 solves many of these problems by providing a fuseholder shown in general by reference numeral 10. Fuseholder 10 is comprised of a base or body 12, rejection contact assembly 14, fuse clip assembly 20, and leaf spring 22. When a cartridge fuse is inserted into fuseholder 10, the standard ferrule 34 of fuse 30 is inserted in fuse clip assembly 20 which provides electrical contact for one end of fuse 30. The other end of fuse 30 is forced downward into rejection contact assembly 14. Spacer 16 has a slot sized to accept rejection nipple 36 and is a width greater than the diameter of rejection nipple 36. As rejection nipple 36 is forced downward, fuse 30 is moved in an axial direction toward leaf spring 22 so that when fuse 30 is in position, leaf spring 22 provides axial pressure forcing the fuse rejection nipple 36 into the rejection contact assembly.

Figure 5:
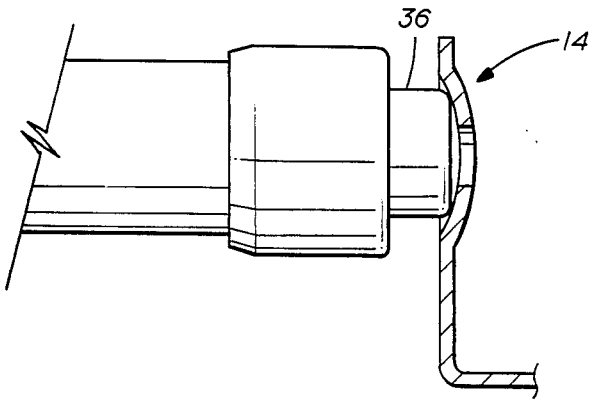
FIG. 5 is a sectional view of the fuseholder rejection contact assembly.
Figure 6:
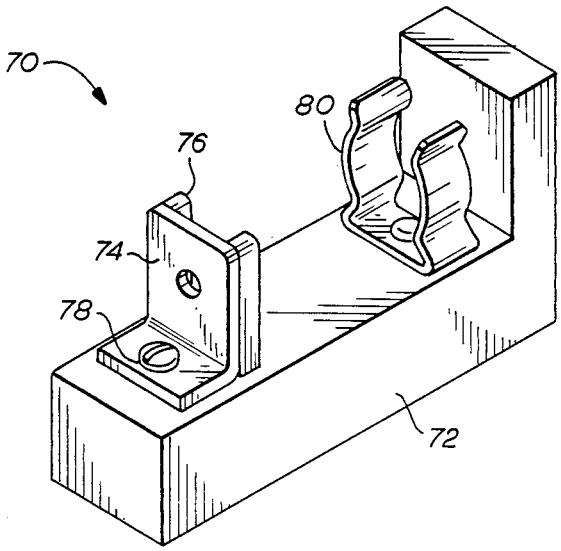
FIG. 6 is a perspective view of an alternate embodiment of the present invention.

FIG. 5 shows a cutaway view of rejection contact assembly 14. It is seen that contact 14 has a face which is concave on the side adapted to receive rejection nipple 36. The diameter of the concave portion is greater than the maximum diameter of rejection nipple 36. In operation, because of the pressure provided by spring 22 in an axial direction, and the concave shape of contact 14, rejection nipple 36 is centered in the concave space and uniform contact is made around the entire circumference of nipple 36, thus ensuring good electrical contact. Because of the axial bias provided by spring 22, fuses of different lengths are easily accommodated. The diameter of the concave side of contact 14 is great enough to accept fuses made by different manufacturers which may vary in diameter and geometry.

In yet another embodiment, a fuseholder is shown in general by reference numeral 70. This fuseholder comprises an insulating base 72, rejection contact 74 and fuse clip 80. Rejection contact 74 and clip 80 are held on base 72 by screws 78. In this embodiment an insulating spacer 76 is mounted directly on the face of rejection contact 74 designed to receive fuse 30. Spacer 76 has a slot of a width greater than the diameter of rejection nipple 36. The rejection contact 74 is an L-shaped piece of conductive metal having sufficient flexibility to provide an axial force when fuse 30 is mounted in holder 70. Ferrule 34 of fuse 30 rests against rear spacer 77 which is made of plastic or other insulating material. In this embodiment, only two metal parts are used, rejection contact 74 and fuse clip 80 which are held on by metal screws 78. Thus, because of the number of parts and the ease of assembly, the manufacturing costs are reduced.

I claim:

1. A fuseholder adapted to receive a cartridge fuse having a rejection nipple at one end, and a ferrule at the other end, comprising:

an insulating body;

a fuse clip at one end of said insulating body adapted to receive said ferrule of said cartridge fuse;

a spring means for biasing said fuse in an axial direction;

a rejection contact mounted at the opposite end of said insulating body from said fuse clip, said rejection contact having a surface which is concave on the side in which said rejection nipple is to be inserted, for receiving and centering said fuse; and, rejection means for rejecting fuses not having a rejection nipple.

2. A fuseholder as in claim 1 wherein said rejection means is a plastic spacer.

3. A fuseholder as in claim 1 wherein a spring means biases said fuse in an axially direction.

4. Fuseholder as in claim 3 wherein said spring means and said rejection contact are the same.

5. A fuseholder adapted to receive a cartridge fuse having a rejection nipple at one end of said cartridge fuse and a ferrule at the other end comprising:

an insulating body;

a fuse clip at one end of said insulating body adapted to receive said ferrule of said cartridge fuse;

a rejection contact mounted at the opposite end of said insulating body from said fuse clip, said rejection contact having a surface which is concave on the side in which said rejection nipple is to be inserted for receiving and centering said fuse; and, rejection means for rejecting fuses not having a rejection nipple.

* * * * *